US007637135B2

(12) United States Patent
Hömig et al.

(10) Patent No.: US 7,637,135 B2
(45) Date of Patent: Dec. 29, 2009

(54) METHOD FOR PRODUCING FROM A METAL SHEET A HOLLOW PROFILE WHICH IS LONGITUDINALLY SLOTTED AND PROVIDED WITH SEVERAL LONGITUDINAL SEGMENTS HAVING DIFFERENT CROSS SECTIONS

(75) Inventors: Lothar Hömig, Voerde (DE); Uwe Kneiphoff, Dinslaken (DE); Thomas Flehmig, Ratingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 10/561,116

(22) PCT Filed: Jun. 22, 2004

(86) PCT No.: PCT/EP2004/006725

§ 371 (c)(1),
(2), (4) Date: Feb. 27, 2007

(87) PCT Pub. No.: WO2005/002753

PCT Pub. Date: Jan. 13, 2005

(65) Prior Publication Data

US 2007/0175261 A1 Aug. 2, 2007

(30) Foreign Application Priority Data

Jul. 1, 2003 (DE) ..... 103 29 424

(51) Int. Cl.
*B21C 37/06* (2006.01)
*B21D 3/00* (2006.01)
*B21D 39/02* (2006.01)

(52) U.S. Cl. ..... 72/368; 72/367.1; 72/51

(58) Field of Classification Search ..... 72/51, 72/367.1, 368, 379.2, 370.14, 370.15, 360, 72/380, 381, 386, 393, 395, 370.04, 370.05, 72/48; 228/150, 151, 152
See application file for complete search history.

(56) References Cited

U.S. PATENT DOCUMENTS

| | | | | | |
|---|---|---|---|---|---|
| 1,805,283 | A | * | 5/1931 | Hammerstrom | 228/151 |
| 1,879,078 | A | * | 9/1932 | Carlsen | 72/368 |
| 3,802,239 | A | | 4/1974 | Karmann et al. | |
| 4,148,426 | A | | 4/1979 | Midzutani et al. | |
| 4,460,118 | A | * | 7/1984 | Ataka et al. | 228/146 |
| 4,603,806 | A | * | 8/1986 | Watanabe et al. | 228/152 |
| 4,606,208 | A | * | 8/1986 | Williamson | 72/133 |
| 4,628,721 | A | * | 12/1986 | Williamson | 72/96 |
| 5,657,922 | A | * | 8/1997 | Lowery et al. | 228/144 |
| 5,743,122 | A | * | 4/1998 | Rhodes et al. | 72/51 |
| 5,924,316 | A | * | 7/1999 | Streubel et al. | 72/51 |

(Continued)

FOREIGN PATENT DOCUMENTS

DE 199 05 365 A1 8/2000

*Primary Examiner*—Dana Ross
*Assistant Examiner*—Teresa M Bonk
(74) *Attorney, Agent, or Firm*—Proskauer Rose LLP

(57) ABSTRACT

A method for producing hollow profiles provided with different cross sections along the length thereof includes shaping the profiles in a die from one piece of cut metal sheet. According to said method, a convex or concave rounding produced on the edges of a longitudinal section results in material excess or material shortage in the transition regions, thereby preventing the material thinning or thickening in said transition regions during forming.

5 Claims, 3 Drawing Sheets

U.S. PATENT DOCUMENTS 6,247,344 B1 6/2001 Eipper ..... 72/61
6,748,786 B2 * 6/2004 Ooyauchi et al. ..... 72/370.14
6,883,552 B2 * 4/2005 Ooyauchi et al. ..... 138/177
2005/0257591 A1 * 11/2005 Hauger et al. ..... 72/368

* cited by examiner

METHOD FOR PRODUCING FROM A METAL SHEET A HOLLOW PROFILE WHICH IS LONGITUDINALLY SLOTTED AND PROVIDED WITH SEVERAL LONGITUDINAL SEGMENTS HAVING DIFFERENT CROSS SECTIONS

BACKGROUND OF THE INVENTION

The invention relates to a method for producing, from a metal sheet, a hollow profile which is longitudinally slotted, in particular as a pre-product of a longitudinal seam welded hollow profile, which consists of several longitudinal segments having different cross sections, at least one segment of which becomes larger or smaller along its length.

Hollow profiles of this kind can be produced by various ways and means. In the case of a first production process, on which the invention is based, the hollow profile is welded together from individual cut metal pieces. Thus a hollow profile with a cylindrical longitudinal segment of small diameter, an adjoining conical longitudinal segment and a cylindrical longitudinal segment of larger diameter joining thereon has to be precise all along a constant wall thickness, but its production is complex because of the longitudinal segments to be cut individually, then to be formed and finally to be welded together. In addition the weld seams form places of irregularities, which are disadvantageous as regards further reworking by shaping, for example by internal high pressure forming, and starting points for crack formation during further shaping and later operational use.

In the case of another known production process the hollow profile is produced from one piece of cut metal sheet. In order to obtain different cross sections in individual longitudinal segments, the hollow profile can be expanded by internal high pressure forming. Should one wish to produce a hollow profile shape of the example described, the cross section expansion would be totally at the expense of the wall thickness. Therefore this production process is only suitable to a limited extent.

Finally a two-stage method for producing a hollow profile with flange is known (DE 199 05 365 A1), wherein in a first stage an otherwise rectangular hollow profile with a hook-shaped flange and a stepped recess is produced. In order to increase the cross section of this hollow profile, it is expanded in a subsequent stage by internal high pressure and as a result attains its final form.

The aforementioned problem of wall thickness change during internal high pressure forming due to different cross sections in individual longitudinal segments of the hollow profile is not solved by this prior art.

SUMMARY OF THE INVENTION

The object of the invention is to develop a less complex production process for hollow profiles having different cross sections in the longitudinal direction from cut metal sheet, in which unwanted local material thinning at most only occurs to a minimum extent and practically no wrinkles arise. The hollow profile should be as uniform as possible over its entire surface, so that it can be further processed without damage.

This object is achieved with a method of the kind specified at the beginning having the following features:

One starts with one piece of cut metal sheet, which at each transition segment from a small cross section to a larger cross section of the later hollow profile has either concave and/or convex longitudinal profile edges in order to provide material to compensate for material shortage and/or material excess in each transition segment during later forming.

The cut metal sheet is formed as a U-shape in its central segment extending in the longitudinal direction, while material is transferred to compensate for material shortage and/or material excess in each transition segment.

The U-shaped formed metal sheet with its closed segment is inserted into a first half of a die corresponding to the hollow profile.

The sides of the U-Shaped formed metal sheet are brought together with a second half of the die using a guide blade for the longitudinal edges, material being transferred in each transition segment to compensate for material shortage and/or material excess.

Release of the hollow profile from the die.

Preferably the U-shape formation already takes place in the first die half, in particular using a correspondingly shaped core.

The invention is based on the idea that in the transition regions, where due to the fabrication of the hollow profile material shortage and/or material excess occurs, which could be compensated while the hollow profile is formed by stretching (thinning) or upsetting (thickening) the wall, this material shortage and/or this material excess being compensated by the concave rounding and/or convex rounding of the boundary regions with material being transferred accordingly, so that a hollow profile also with longitudinal segments having different diameters is produced in the die from one piece of cut metal sheet without significant thinning and thickening even in the critical transition segments. It goes without saying that "convex rounding" and "concave rounding" does not cover strictly circular arc-shaped profile edges, but all profile edges, which do not have the otherwise sharp corners at the transitions, in particular edges, which follow a polynomial, constant curve progression.

In order to facilitate shaping in the die, the cut metal sheet can be bent inwards along its longitudinal edges before forming in the die. In this case the bend radius of the bent longitudinal edges should be at most equal to the smallest bend radius of the hollow profile.

BRIEF DESCRIPTION OF THE DRAWINGS

The invention is described in detail below with reference to a drawing, wherein.

Figure 5:
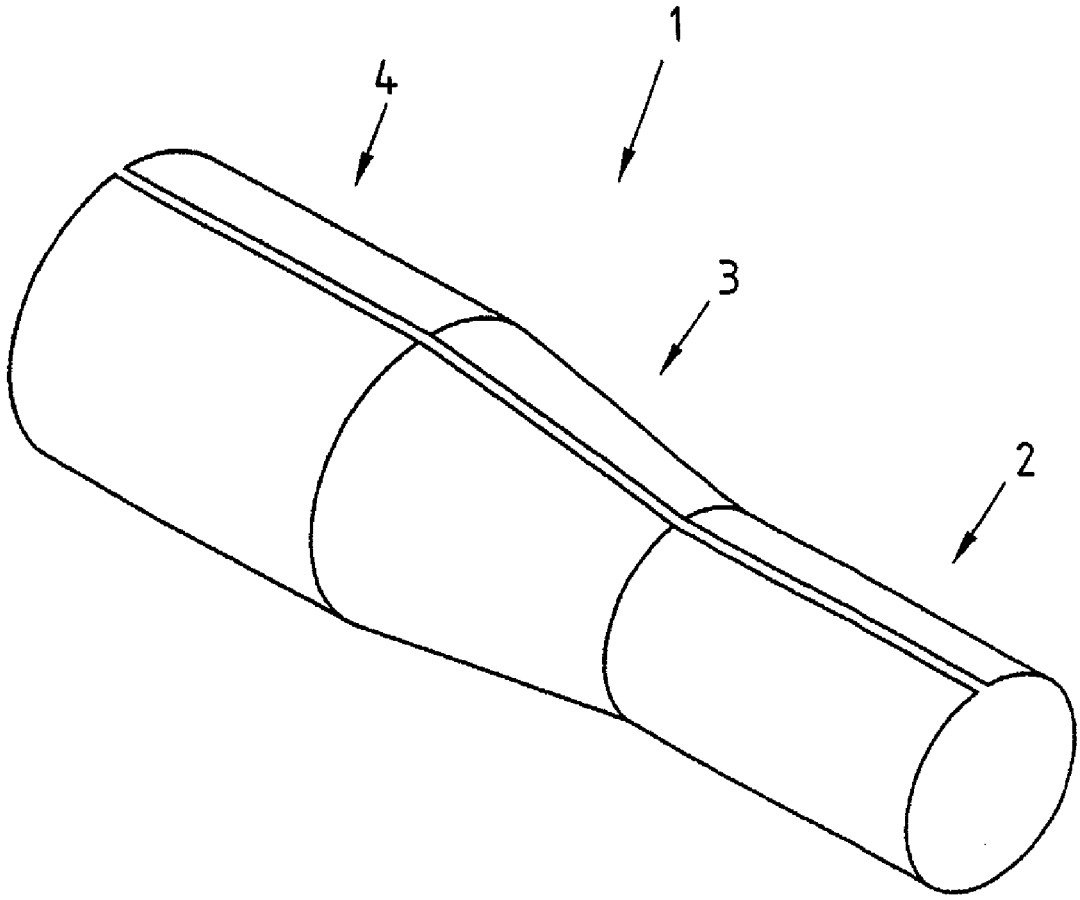

FIG. 5 shows in perspective the hollow profile after release from the die.

DETAILED DESCRIPTION OF THE INVENTION

In the embodiment hollow profile 1 according to FIG. 5 is formed from one piece of cut metal sheet, which is composed of three longitudinal segments 2, 3, 4, a cylindrical longitudinal segment 2 of small diameter, a conically expanding longitudinal segment 3 and a cylindrical longitudinal segment 4 of larger diameter. The piece of cut metal sheet can be divided accordingly into three segments 5, 6, 7. The segments 5 and 7 have a substantially rectangular cross section, while the intermediate segment 6 has a substantially trapezoidal cross section. A characteristic of this piece of cut metal sheet 5, 6, 7 is constituted by the fact that in the transition segments 8, 9 between the segments 5, 6, 7 the otherwise straight profile edges are rounded, and to be precise the profile edges 8*a*, 8*b* from the smaller rectangular segment 5 to the trapezoidal segment 6 are convex, while the profile edges 9*a*, 9*b* from the trapezoidal segment 6 to the larger rectangular segment 7 are concave. As a result additional material is made available to the transition segment 8, while material is removed from the transition segment 9. With this material addition and/or material removal, material shortage within the segments 8*c*, 8*d* of the transition segment 8 and material excess within the segments 9*c*, 9*d* of the transition segment 9, which would level off during production of the hollow profile, are compensated.

This principle of adding material and/or removing material at transition segments 8, 9, which in the case of the embodiment is illustrated for a simple geometrical shape, can also be realized with more complicated hollow profile shapes, even with elliptical, rectangular and variously shaped transition segments, for example from circular to rectangular and the like.

Figure 1:
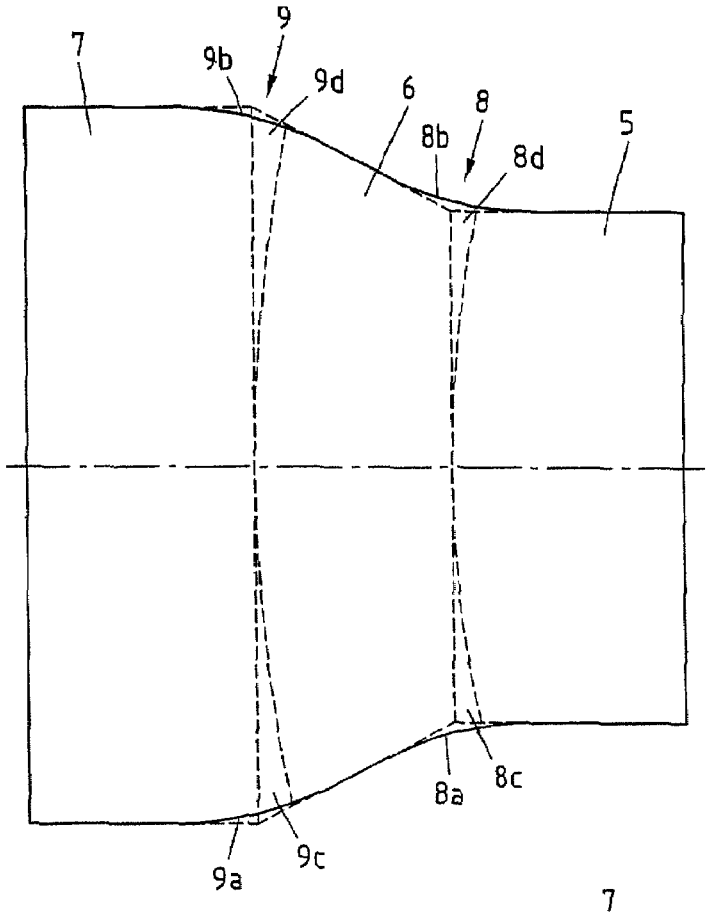
FIG. 1 shows a piece of cut metal sheet.
Figure 2:
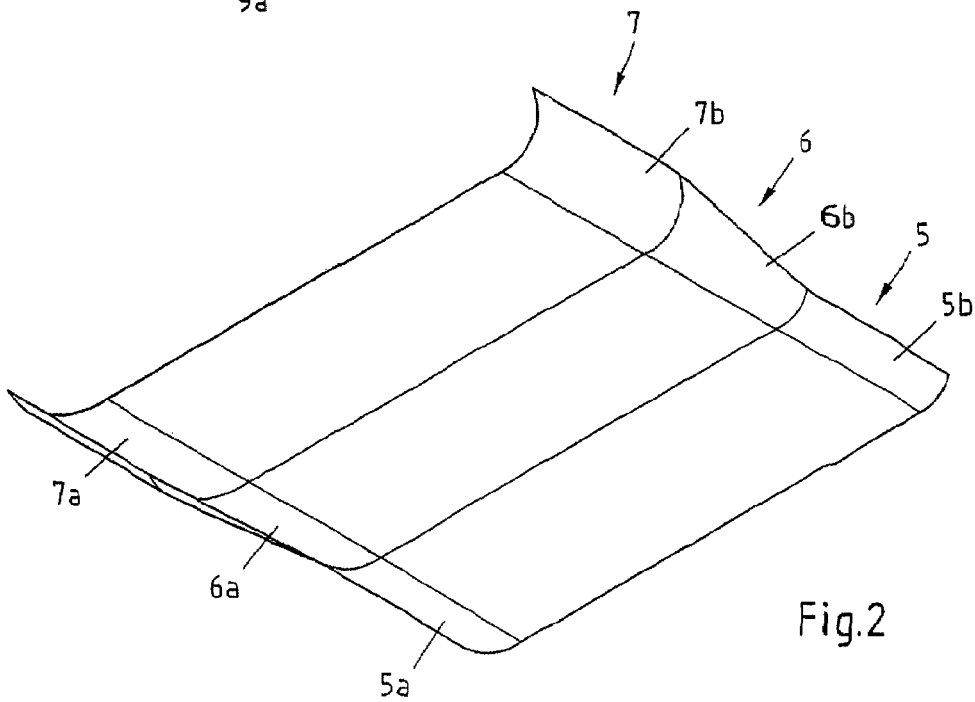
FIG. 2 shows the cut metal sheet according to FIG. 1 with bent longitudinal edges.

The cut metal sheet in accordance with FIG. 1 is shaped gradually to form the hollow profile of FIG. 5. Preferably first the longitudinal edges 6*a*, 6*b*, 7*a*, 7*b*, 5*a*, 5*b* are bent inwards, in particular with a bend radius which is at most equal to the smallest bend radius of the later hollow profile. The cut metal sheet prepared in this way for the actual shaping is illustrated in FIG. 2.

Figure 3:
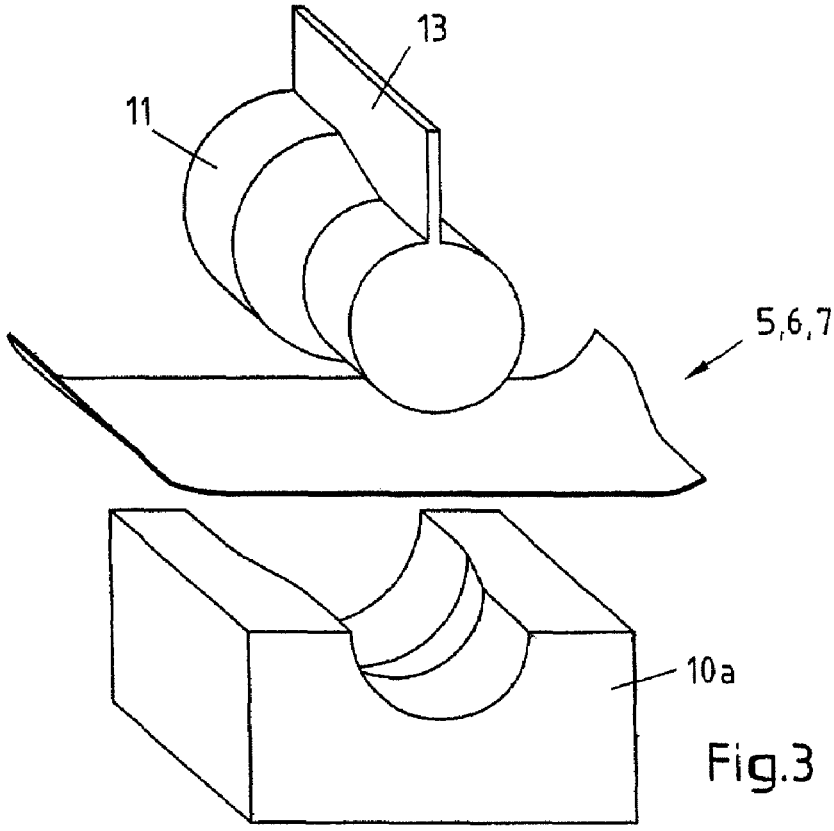
FIG. 3 shows in perspective a first forming stage of the cut metal sheet according to FIGS. 1 and 2 in a die with a core.

This cut metal sheet 5, 6, 7 with its central segment extending in the longitudinal direction is then formed according to FIG. 3 in a first half 10*a* of a die 10*a*, 10*b* adapted to the later hollow profile with the aid of a core 11, so that a U-shaped part emerges with upright sides 12*a*, 12*b*. Already at this forming stage in the first die half 10*a* material is transferred to the transition segments 8, 9, so that upsetting and material thickening or thinning in the transition regions is only required at most to a very minimum extent.

Figure 4:
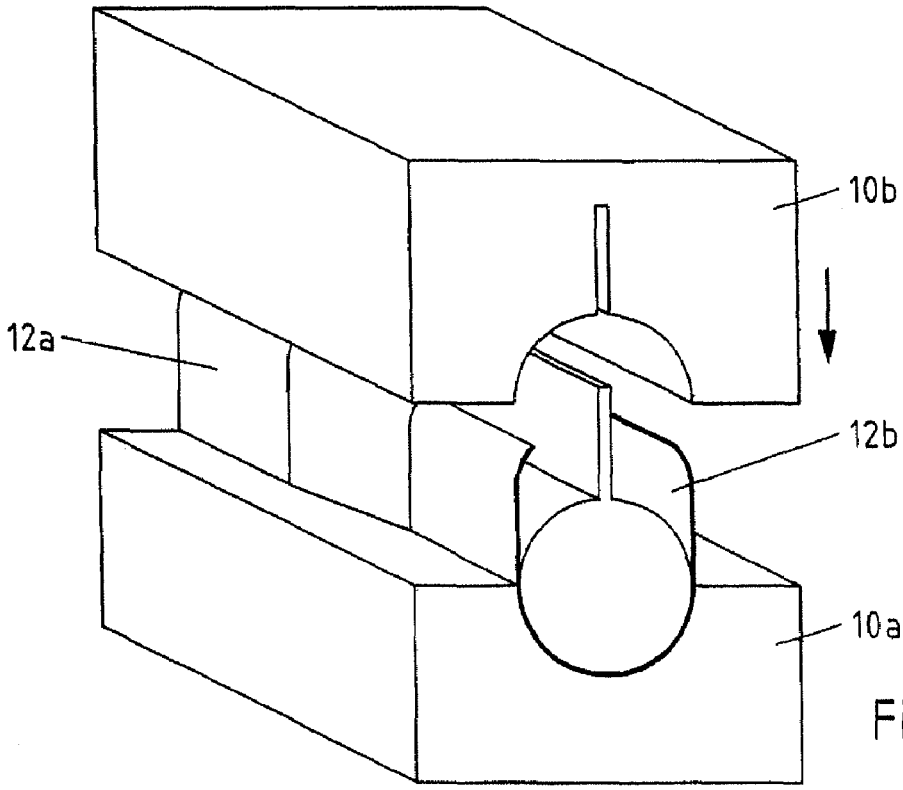
FIG. 4 shows in perspective a second forming stage of the cut metal sheet according to FIGS. 1 and 2 in the die of FIG. 3.

In a further forming stage in accordance with FIG. 4 if necessary after removing the core 11, the sides 12*a*, 12*b* are bent towards one another with a second die half 10*b*, by coming into contact with the latter when the second die half 10*b* is lowered, until the die 10*a*, 10*b* is completely closed. In this case a blade 13 held by the core 111 serves to centre the longitudinal edges. Also during this second forming stage material is transferred to the transition segments 8.9, so that material thinning or material thickening substantially does not arise.

After releasing the metal sheet formed into the hollow profile the longitudinal edges meet one another and form a linear weld-able edge join. The preformed hollow profile produced in this way is available after the longitudinal seam has been welded for further shaping, for example by internal high pressure forming, wherein it needs only comparatively little further forming because of the pre-forming.

It goes without saying that in the case of the hollow profiles having cross sections at both ends smaller than in the middle segment, the core must be removed for the second forming stage. In this case the blade 13 together with the second die half 10*b* takes over the guiding function. It also goes without saying that the blade 13 can be held in any arbitrary manner, for example also by the second die half 10*b*.

The invention claimed is:

1. A method for producing from a flat metal sheet, a longitudinally slotted hollow profile with constant wall thickness comprising a plurality of transition segments having different cross sections, at least one transition segment of which becomes larger or smaller along its length, the method comprising:

providing one piece of cut metal sheet comprising either concave or convex longitudinal edges to compensate for material shortage or material excess in each transition segment;

forming the cut metal sheet as a U-shape in a central segment extending in a longitudinal direction;

inserting the U-shaped metal sheet in a first half of a die corresponding to the hollow profile;

bringing together, sides of the U-shaped metal sheet with a second half of the die using a core comprising a guide blade for longitudinal edges;

forming the hollow profile comprising the plurality of transition segments, each transition segment having a substantially similar wall thickness to provide a constant wall thickness throughout the hollow profile; and releasing the hollow profile from the die.

2. The method according to claim 1, wherein the U-shaped formation of the cut metal sheet takes place in the first half of the die.

3. The method according to claim 2, wherein the cut metal sheet is bent inwards along its longitudinal edges before shaping in the die.

4. The method according to claim 1, wherein the cut metal sheet is bent inwards along its longitudinal edges before shaping in the die.

5. The method according to claim 4, wherein a bend radius of bent longitudinal edges is at most equal to a smallest bend radius of the hollow profile.

* * * * *